United States Patent [19]

Carry

[11] Patent Number: 4,633,914

[45] Date of Patent: Jan. 6, 1987

[54] TAKE-UP TENSION CONTROL

[75] Inventor: William B. Carry, Union, S.C.

[73] Assignee: Milliken Research Corporation, Spartanburg, S.C.

[21] Appl. No.: 838,874

[22] Filed: Mar. 10, 1986

Related U.S. Application Data

[63] Continuation of Ser. No. 252,777, Apr. 10, 1981, abandoned.

[51] Int. Cl.[4] ..... D03D 49/20; D06C 3/00

[52] U.S. Cl. ..... 139/1 R; 139/304; 26/70; 66/149 R; 66/166

[58] Field of Search ..... 139/309, 304, 1 R, 1 B, 139/336; 26/70; 66/166, 149, 157; 242/75.5, 75.51

[56] References Cited

U.S. PATENT DOCUMENTS

| | | | |
|---|---|---|---|
| 2,304,971 | 12/1942 | Tuttle et al. . | |
| 2,346,047 | 4/1944 | Otto . | |
| 2,389,047 | 11/1945 | Heinz . | |
| 2,392,226 | 1/1946 | Butterworth et al. . | |
| 2,440,958 | 5/1948 | Kronoff et al. . | |
| 2,581,328 | 1/1952 | Malcom . | |
| 2,608,741 | 9/1952 | Reeves . | |
| 2,753,128 | 7/1956 | Thomas et al. . | |
| 3,164,332 | 1/1965 | Walker et al. | 139/309 UX |
| 3,341,148 | 9/1967 | Cooper | 139/304 UX |
| 3,385,535 | 5/1968 | Dodsworth . | |
| 3,502,115 | 3/1970 | Barnett | 139/304 X |
| 3,650,490 | 3/1972 | Saunders . | |
| 3,863,241 | 1/1975 | Kamiyamaguchi et al. | 139/370.2 UX |
| 4,067,365 | 1/1978 | Gotoh | 139/336 X |
| 4,129,154 | 12/1978 | Bennelli . | |

*Primary Examiner*—James Kee Chi

*Attorney, Agent, or Firm*—Earle R. Marden; H. William Petry

[57] ABSTRACT

Apparatus and method to detect high tension in a web material being taken-up and cutting off the take-up device upon such detection to prevent stretching and necking of the fabric being handled. The detection device provides a time delay between detection of the condition of high tension and deactivation of the fabric take-up apparatus.

1 Claim, 2 Drawing Figures

TAKE-UP TENSION CONTROL

This is a continuation of application Ser. No. 252,777, filed Apr. 10, 1981, now abandoned.

Most fabric making machines are coordinated with a take-up mechanism which continuously takes up the fabric being produced. The speed of the take-up device is normally coordinated to the speed of production of the fabric to maintain proper tension on the fabric being produced. During fabric production the tension on the fabric between the fabric producing machine and the take-up mechanism may become excessive causing the fabric to be stretched in the warp direction and narrowed or necked in the weft or fill direction. This condition is undesirable when the produced fabric has to conform to a pre-determined specification setting forth certain lengths, widths and weight of fabric per unit length.

Therefore, it is an object of the invention to provide a method and apparatus to cut-off the take-up mechanism of a fabric producing machine when the tension on the produced fabric becomes excessive.

Figure 1:
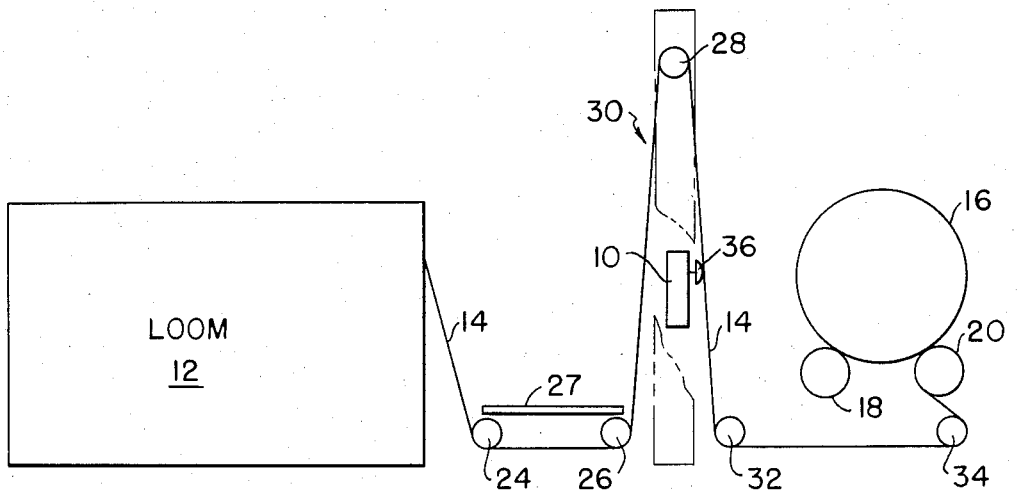
Figure 2:
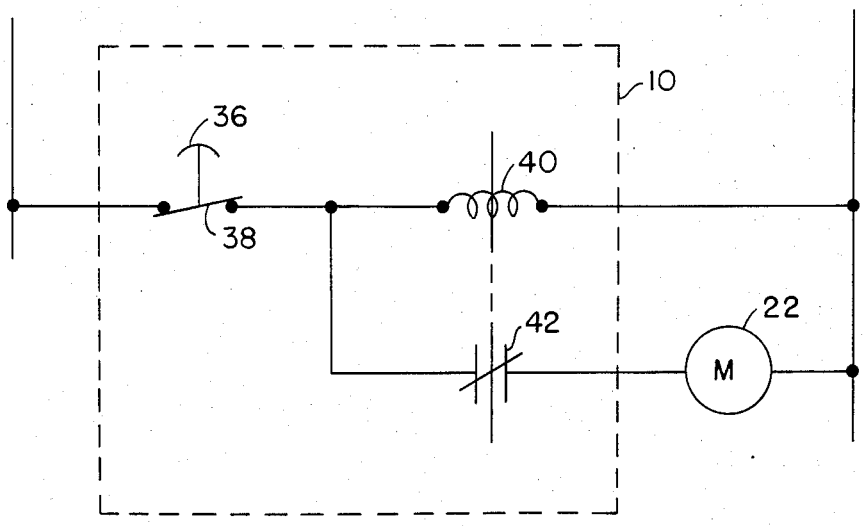

Other objects and advantages of the invention will become readily apparent as the specification proceeds to describe the invention with reference to the accompanying drawings, in which:

FIG. 1 is a schematic representation of a fabric producing system incorporating the new tension detector, and FIG. 2 is a schematic representation of the tension detector control circuit.

Looking now to FIG. 1 the tension detector 10 is shown employed in conjunction with a loom 12 producing a woven fabric 14 which is taken up on a take-up roll 16 which in turn is driven by surface drive rolls 18 and 20 driven by a motor 22 (FIG. 2). The fabric 14, woven by the loom 12 and guided by idler rolls 24 and 26, passes under the inspection platform 27 to the inspection station 30. The fabric is guided by roll 26 upward to the idler roll 28 and then downward and under the idler roll 32. From the idler roll 32 the fabric passes partially around the roll 34 to the take-up roll 16. The detector 10 is adjacent to the downward path of the fabric from the roll 28 and has the dish-shaped switch actuator member 36 in close proximity to the fabric 14.

OPERATION

When the tension on the fabric 14 becomes excessive due to the stopping of the loom 12 or an unbalanced condition in the system, the fabric 14 between the rolls 28 and 32 will tighten and push against the dish-shaped member 36 to open the switch 38. Opening the switch 38 will de-energize the relay coil 40 to allow the time-delay relay switch 42 to open after a pre-determined length of time to de-energize the motor 22 driving the take-up roll surface drive rolls 18 and 20. When the tension in the fabric has been released, the biased switch 38 will close to engage the relay coil, close the time-delay relay switch 42 and start the motor 22. The time delay switch 42 allows the take-up roll 16 to maintain a pre-determined amount of tension on the fabric 14 and prevents excessive stopping and starting of the motor 22 due to momentary changes in fabric tension. Excessive start-up of the motor 22 will result in motor failure.

It can readily be seen that the disclosed method and apparatus provides a system wherein excessive tension on a fabric being produced is avoided and also provides protection for the motor during the take-up mechanism of the machine.

Although I have described in detail the preferred embodiment of the invention it is contemplated that many changes may be made without departing from the scope or spirit of the invention and I desire to be limited only by the claims.

I claim:

1. A machine to produce and take-up a running length of fabric comprising: a fabric producing machine, a take-up mechanism operably associated with said fabric producing machine to take-up fabric produced on said machine, drive means operably associated with said mechanism and detector means located between said machine and said mechanism to automatically detect a pre-determined tension above that desired in the length of fabric and de-activate said drive means upon such detection, said detector means including a disc shaped feeler adjacent the path of the running length of fabric and a control circuit with a switch thereon connected to said feeler wherein said control circuit including a time delay means therein to delay deactivation of said drive means upon the detection of the pre-determined tension.

* * * * *